US011255360B2

(12) United States Patent
Forthofer et al.

(10) Patent No.: US 11,255,360 B2
(45) Date of Patent: Feb. 22, 2022

(54) SURFACE FOR DIRECTIONAL FLUID TRANSPORT

(71) Applicant: Kimberly-Clark Worldwide, Inc., Neenah, WI (US)

(72) Inventors: Marsha R. Forthofer, Woodstock, GA (US); Werner Baumgartner, Kirchschlag (AT); Gerda Buchberger, Zwettl an der Rodl (AT); Florian Hischen, Dorrenbach (DE); Philipp Comanns, Aachen (DE)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 480 days.

(21) Appl. No.: 16/095,049

(22) PCT Filed: Apr. 29, 2016

(86) PCT No.: PCT/US2016/030033

§ 371 (c)(1),
(2) Date: Oct. 19, 2018

(87) PCT Pub. No.: WO2017/188977

PCT Pub. Date: Nov. 2, 2017

(65) Prior Publication Data

US 2019/0101142 A1 Apr. 4, 2019

(51) Int. Cl.

| | |
|---|---|
| ***F15D 1/02*** | (2006.01) |
| ***F04F 10/00*** | (2006.01) |
| ***F04B 19/00*** | (2006.01) |

(52) U.S. Cl.

CPC ..... *F15D 1/02* (2013.01); *F04B 19/006* (2013.01); *F04F 10/00* (2013.01)

(58) Field of Classification Search

None

See application file for complete search history.

(56) References Cited

U.S. PATENT DOCUMENTS 4,549,952 A 10/1985 Columbus
4,637,819 A 1/1987 Ouellette et al.
(Continued)

FOREIGN PATENT DOCUMENTS

CA 2875722 12/2014
EP 0470202 B1 6/1994
(Continued)

OTHER PUBLICATIONS

Feng et al., "One-way wicking in open micro-channels controlled by channel topography", 2013, Journal of Colloid and Interface Science 404, 169-178 (Year: 2013).*
(Continued)

*Primary Examiner* — Paul S Hyun
(74) *Attorney, Agent, or Firm* — Kimberly-Clark Worldwide, Inc.

(57) ABSTRACT

A capillary structure for passive, directional fluid transport includes a capillary having a forward direction and a backward direction, the capillary including first and second capillary units each having a sequence of capillary components including a connective section in fluid communication with a diverging section, the diverging section having a forward side and dimensions inducing a concave meniscus in the forward direction, wherein the connective section of the second capillary unit is connected to the forward side of the diverging section of the first capillary unit to form at least one transition section, and wherein a change in the dimensions in the transition section induces in the backward direction a convex liquid meniscus or a straight liquid meniscus with an infinite radius of curvature.

12 Claims, 5 Drawing Sheets

(56) References Cited

U.S. PATENT DOCUMENTS

| | | | |
|---|---|---|---|
| 5,149,408 | A | 9/1992 | Perlman |
| 5,628,736 | A | 5/1997 | Thompson |
| 5,648,142 | A | 7/1997 | Phillips |
| 5,693,169 | A | 12/1997 | Langdon et al. |
| 6,103,376 | A | 8/2000 | Phillips et al. |
| 6,231,948 | B1 | 5/2001 | Ouellette et al. |
| 6,232,521 | B1 | 5/2001 | Bewick-Sonntag et al. |
| 6,290,685 | B1 | 9/2001 | Insley et al. |
| 6,294,710 | B1 | 9/2001 | Schmidt et al. |
| 6,562,014 | B2 | 5/2003 | Lin et al. |
| 6,761,957 | B1 | 7/2004 | Phillips et al. |
| 6,811,842 | B1 | 11/2004 | Ehmsperger et al. |
| 8,182,455 | B2 | 5/2012 | Carasso et al. |
| 8,344,203 | B2 | 1/2013 | Seyler et al. |
| 8,426,670 | B2 | 4/2013 | Nagasuna et al. |
| 2004/0203239 | A1 | 10/2004 | Gilton |
| 2007/0295372 | A1 | 12/2007 | Yang et al. |
| 2010/0084113 | A1 | 4/2010 | Lee |
| 2010/0136289 | A1 | 6/2010 | Extrand et al. |
| 2010/0267162 | A1* | 10/2010 | Kartalov ..... B01L 3/502753 436/149 |
| 2011/0171043 | A1 | 7/2011 | Jeoung et al. |
| 2012/0082599 | A1 | 4/2012 | Weber |

FOREIGN PATENT DOCUMENTS

| | | | |
|---|---|---|---|
| KR | 100668553 | B1 | 1/2007 |
| RU | 2206202 | C2 | 6/2003 |
| WO | WO14000735 | A1 | 1/2014 |

OTHER PUBLICATIONS

Feng, Jiansheng and Rothstein, Jonathan P., "One-way wicking in open micro-channels controlled by channel topography", Journal of Colloid and Interface Science 404 (2013) 169-178.

* cited by examiner

SURFACE FOR DIRECTIONAL FLUID TRANSPORT

BACKGROUND

Typically, large masses of materials are required to move fluid volumes due to the random orientation of fibers in many porous structures found in absorbent and fluid handling structures. As a result, several materials with different properties are used in combination to transport fluid. A surface that could enhance movement of fluid would allow a structure to perform better and to take advantage of capacity that is not typically used. Such a surface can be formed or placed to facilitate liquid movement. In this manner, fluid does not move randomly but instead follows the surface structure. This provides one the ability to design where fluid travels.

Previous, unsuccessful attempts to address these or related problems include Canadian Patent Application No. CA2875722 A1 to Comanns et al., which describes interconnected capillaries, and the technical publication "One-way Wicking in Open Micro-channels Controlled by Channel Topography," Journal of Colloid and Interface Science 404 (2013) 169-178, which describes a directional fluid transport that attempts to minimize, but does not eliminate, backflow.

SUMMARY

The disclosure described herein solves the problems described above and provides an increase in efficacy in fluid handling.

In accordance with the present disclosure, a capillary structure for passive, directional fluid transport includes a capillary having a forward direction and a backward direction, the capillary including first and second capillary units each having a sequence of capillary components including a connective section in fluid communication with a diverging section, the diverging section having a forward side and dimensions inducing a concave meniscus in the forward direction, wherein the connective section of the second capillary unit is connected to the forward side of the diverging section of the first capillary unit to form at least one transition section, and wherein a change in the dimensions in the transition section induces in the backward direction a convex liquid meniscus or a straight liquid meniscus with an infinite radius of curvature.

The disclosure also describes a substrate for directional transport of a fluid having a contact angle $\theta$, the substrate including a capillary structure for passive, directional fluid transport, the capillary structure including a capillary having a forward direction and a backward direction, the capillary including first and second capillary units each having a sequence of capillary components including a connective section in fluid communication with a diverging section, the diverging section having a forward side and dimensions inducing a concave meniscus in the forward direction, wherein the connective section of the second capillary unit is connected to the forward side of the diverging section of the first capillary unit to form at least one transition section, and wherein a change in the dimensions in the transition section induces in the backward direction a convex liquid meniscus or a straight liquid meniscus with an infinite radius of curvature.

The disclosure further describes a capillary structure for passive directional transport of a fluid having a contact angle $\theta$ with regard to the capillary structure, the structure including a capillary including a plurality of capillary units each having a sequence of capillary components including a connective section in fluid communication with a diverging section, the diverging section followed by a transition section, wherein the connective section has an aspect ratio $a_{connective} > \frac{1}{2}((1/\cos\theta)-1)$, wherein the diverging section diverges from the connective section at an angle $\alpha$ such that $\alpha/2 < \pi/2-\theta$, and wherein the transition section incorporates an abrupt change in width from the diverging section of one capillary unit to the connective section of the next capillary unit.

Other features and aspects of the present disclosure are discussed in greater detail below.

BRIEF DESCRIPTION OF THE DRAWINGS

The foregoing and other features and aspects of the present disclosure and the manner of attaining them will become more apparent, and the disclosure itself will be better understood by reference to the following description, appended claims and accompanying drawings, where:

Figure 1:
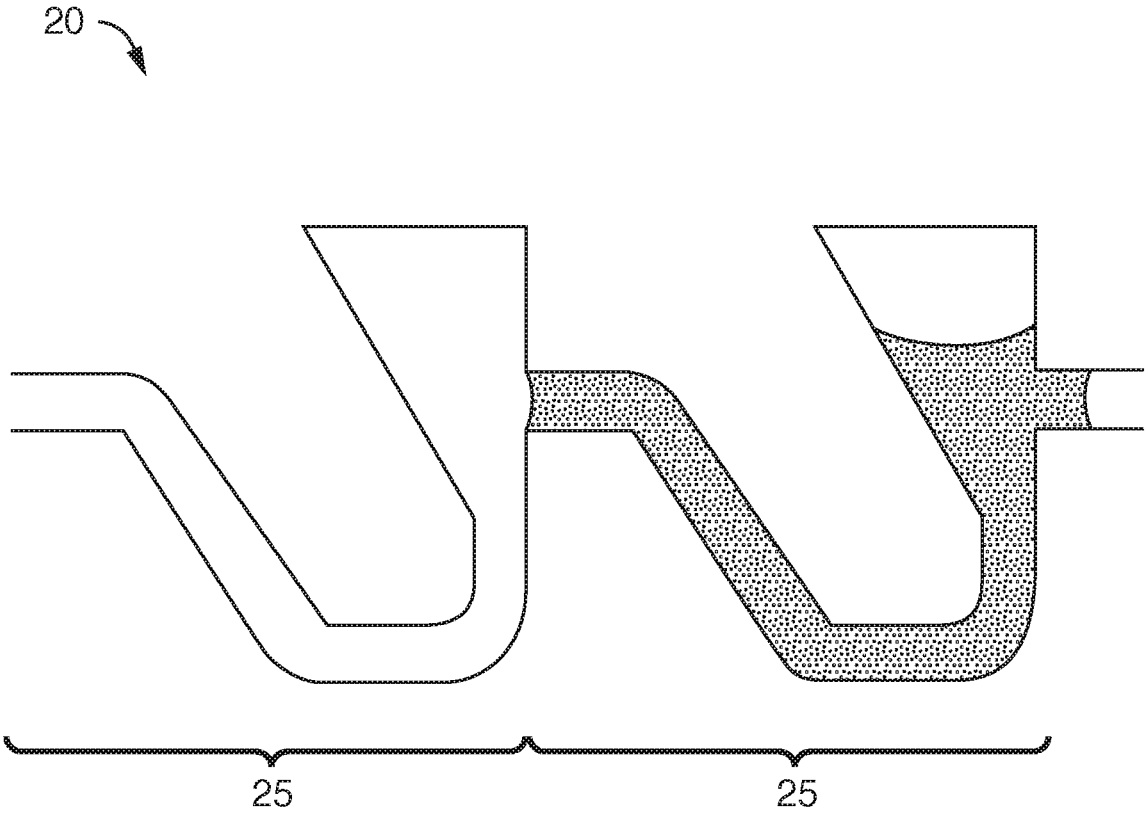
FIG. 1 is a schematic plan illustration of the surface design of the capillaries of a liquid diode of the present disclosure.

Repeat use of reference characters in the present specification and drawings is intended to represent the same or analogous features or elements of the present disclosure. The drawings are representational and are not necessarily drawn to scale. Certain proportions thereof might be exaggerated, while others might be minimized.

DETAILED DESCRIPTION

It is to be understood by one of ordinary skill in the art that the present discussion is a description of exemplary aspects of the present disclosure only, and is not intended as limiting the broader aspects of the present disclosure.

The present disclosure is generally directed to applications benefiting from directional fluid transport. In general, the application spectrum of such a directional liquid transport is broad and ranges from absorbent articles to microfluidics, medical applications, distilleries, heat exchangers, electronics cooling, filtration systems, lubrication, e-ink displays, and water harvesting devices.

The present disclosure is directed to a surface for directional fluid transport including complete directional liquid transport by capillary forces. The design allows for directional flow against gravity (or not against gravity) through usage of closed or open capillaries (i.e., capillaries) to control fluid transport from a source location to a separate desired location.

In one example, large masses of materials are required to move fluid volumes due to the random orientation of fibers in many porous structures. As a result, in one approach several materials with different properties are used in combination to transport fluid. A surface that could enhance movement of fluid, particularly into the more remote parts of a structure would allow the structure to take advantage of flow area or absorbent capacity that is not typically used. Such a surface, for example, can be formed or placed on a laminate or on a film to facilitate liquid movement. In this manner, fluid does not move randomly but instead follows the surface structure. This provides one the ability to design where fluid travels.

In addition, fibrous, porous structures are prone to pore collapse or fouling once wetted, resulting in inefficiencies in liquid transportation. The surface structure of the present disclosure is designed such that the capillaries provide renewable void space by transferring liquid out of the channels to another location or to a storage material, thus making the channels available again for use. This can be achieved by fabricating the material out of a film, a gel, a film-like structure, or rigid materials including rigid polymer materials.

All materials with a contact angle of $0<\theta<90°$ (inherently or by treatment) are suitable for directional liquid transport according to the present disclosure. Examples of suitable materials include polymers, metals, ceramics, semi-conductors, glasses, films, nonwovens, or any other suitable material. The term polymer is not restricted to technical polymers but incorporates biodegradable polymers such as cellulose compounds, polyphosphazenes, polylactic acids (PLAs), and elastomers such as poly(dimethylsiloxane) (PDMS). Especially suitable for use in the present application are polymers such as poly(methylmethacrylate) (PMMA), PLAs, polypropylene (PP), silicones, epoxy resins, hydrogels, polyamide (PA), polyethylene terephthalate (PET), cellulose acetate (CA), and cellulose acetate butyrate (CAB). Materials that do not have an inherent contact angle of $0<\theta<90°$ can be changed by surface or chemical treatments such as plasma modification, corona discharge, spin coating, spray coating, or by any suitable method or combination of methods. The material can be or can be made hydrophilic or lipophilic.

With respect to the specific surface structure of the present disclosure, the substrate on which the surface structure is formed includes a surface that has a contact angle to liquid of less than 90° at least at some areas where fluid flows. The surface has a structure that includes a plurality of capillaries with a unique sequential arrangement of capillary components of different elementary types.

The structure can be laser-engraved or formed by other manufacturing methods into a PMMA ((poly)methylmethacrylate) plate or other suitable polymeric substrate. Suitable manufacturing methods include hot embossing, screen printing, 3D printing, micromilling, casting, injection-molding, imprinting, etching, photo-lithography including optical lithography and UV lithography, photopolymerization, two-photon polymerization, or any other suitable method or combination of methods.

In contrast to other microfluidic diode technologies, movable parts like flaps or cylindrical discs are avoided in the structure of the present disclosure. The present disclosure employs conventional bulk materials without a need for chemical treatment or the use of porous substrates. While the present disclosure provides a structure for one-way wicking, the fabricated structures also allow for a complete halting of the liquid front in the reverse direction.

The performance of the structures of the present disclosure eliminate the requirement for interconnection of two or more capillaries as shown in previous attempts such as those in Canadian Patent Application No. CA2875722 A1 to Comanns et al., which describes interconnected capillaries. The single capillaries of the present disclosure suffice for pronounced directional fluid transport. In other aspects of the present disclosure, however, the capillaries can be interconnected if a capillary network is needed. For example, a network of several capillaries can be more fault-tolerant in response to a blockage in one or more capillaries in that alternative paths are provided to circumvent obstacles blocking single capillaries.

The structure described herein provides advantages due to the different design as compared to previous structures. The structure provides for higher volumetric flow (i.e., per a given surface area in contact with the fluid) due in part to the capacity for packing the capillaries more densely, because there is no need for interaction between two capillaries. In other words, there is no oscillating flow between two interacting capillaries. This higher volumetric flow is due to higher transport velocities because there is no oscillating flow that tends to limit transport velocity in the forward direction. In addition, the capillaries of the present disclosure are simpler in design. As a result, the structure is more tolerant of variations in the capillary dimensions, which means that the structure is more tolerant of variations in wetting properties of the applied fluids (e.g., surface tensions and contact angles). The structure is also more tolerant of fabrication errors.

Figure 2A:
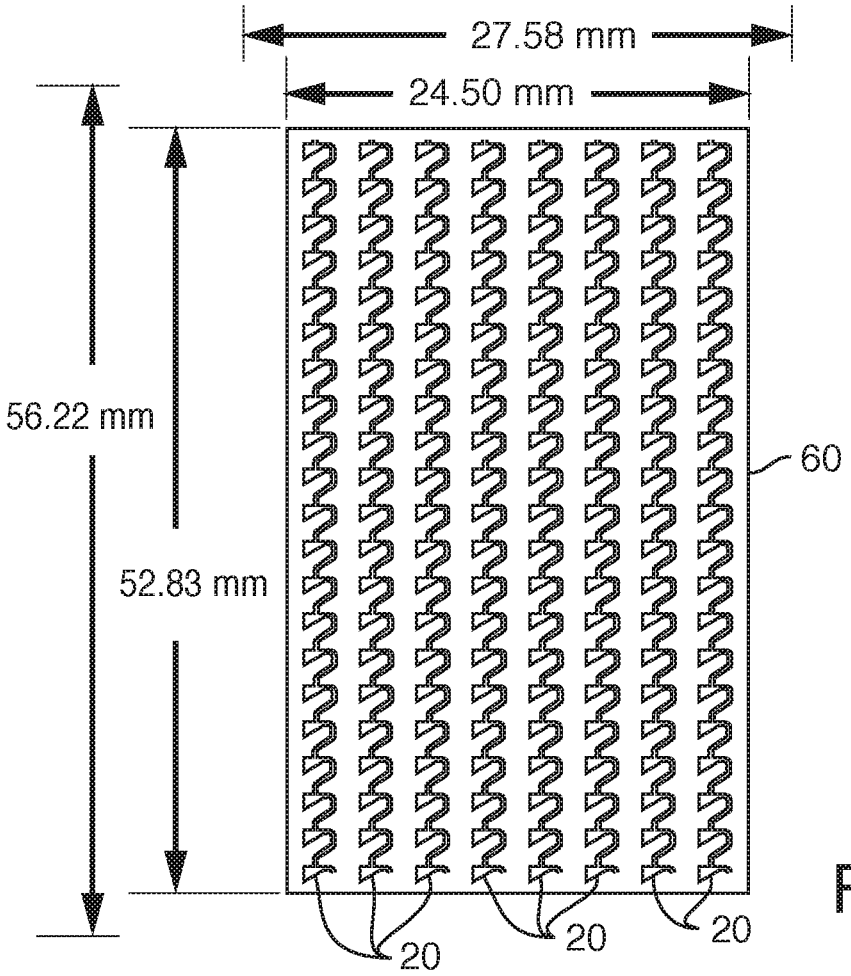
FIG. 2A is a schematic plan view of a parallel arrangement of multiple capillaries of the type illustrated in FIG. 1, with exemplary dimensions.

FIG. 1 illustrates one exemplary general arrangement of a capillary 20 having two successive capillary units 25. A capillary 20 includes one or more capillary units 25 arranged linearly, where each capillary unit 25 is in fluid communication with the previous and the succeeding capillary units 25. Two or more capillaries 20 can be arranged in a side-to-side arrangement to provide parallel fluid paths, as illustrated in FIG. 2A. The capillaries 20 described herein can be open or closed in the z-direction, which is the direction perpendicular to the x-y plane of the figures.

Although fluid flow through the capillaries 20 can be in the forward or backward directions, net flow should be in the forward direction. Net flow in the forward direction is also known as directional flow.

Figure 3:
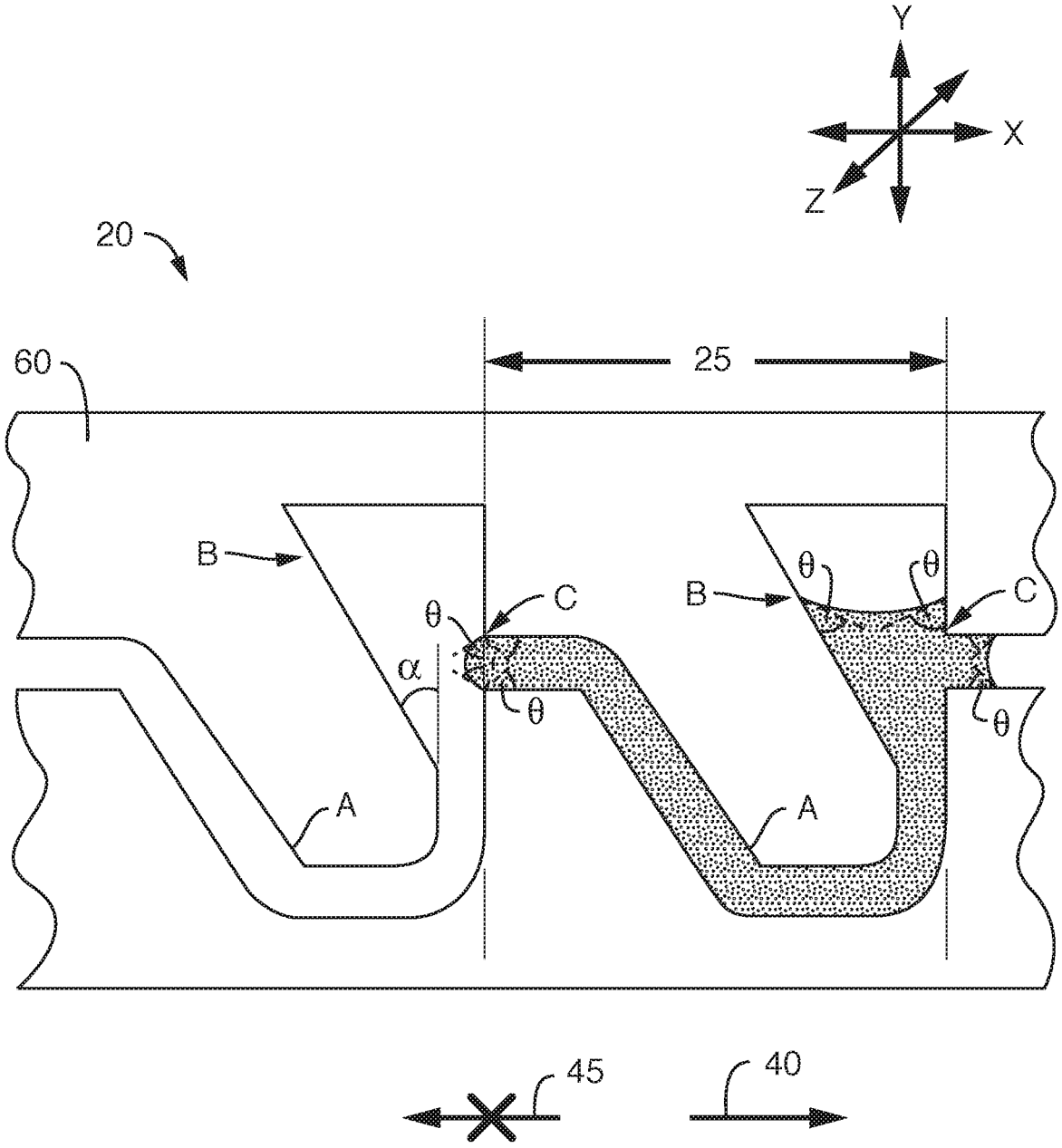
FIG. 3 is a schematic view of a liquid diode of the present disclosure for passive, directional liquid transport including two periods or capillary units of the structure with flow in a forward direction and halting of the liquid front in a backward direction. The transition point indicated at C is illustrated in more detail in FIG. 5.
Figure 4A:
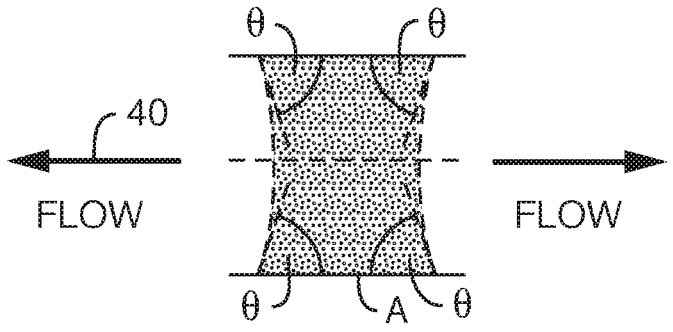
FIG. 4A is a schematic cutaway view of a connective capillary component for bidirectional flow, indicated at A in FIG. 3.
Figure 4B:
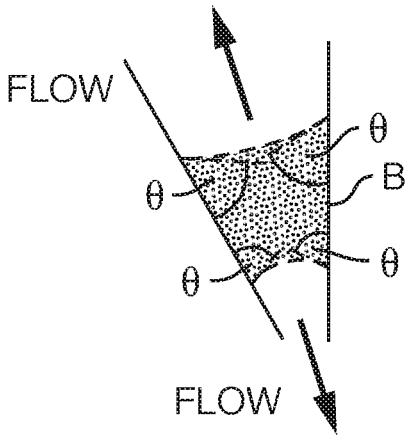
FIG. 4B is a schematic cutaway view of a conic capillary component with small angles of slope a for bidirectional flow, indicated at B in FIG. 3.
Figure 4C:
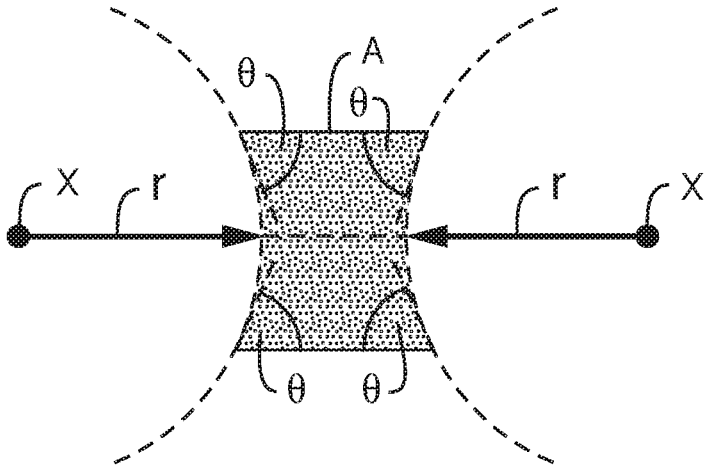
FIG. 4C is a schematic cutaway view of a connective capillary component for bidirectional flow, indicated at A in FIG. 3, with a radius of curvature defined.

As illustrated in FIGS. 3-4C and as described in more detail below, a capillary unit 25 includes at least two elementary types of capillary components of defined shape. Included are a moderately widening capillary component and a capillary component with a rapid transition from narrow to wide (or vice versa). A capillary unit 25 can also include a connective section capillary component. The elementary types of capillary components are arranged sequentially in a unique way, and this unique sequential arrangement of elementary types of capillary components leads to passive directional fluid transport in a forward direction 50, even against gravity.

The structure of the present application includes at least a single capillary 20, with or without any junctions or forks that connect to other capillaries. Each capillary 20 includes a potentially-repeating sequence of three specific geometric parameters, the designs of which are dependent on the fluid properties in combination with properties of the substrate. The geometric parameters are a connective section A, a diverging section B, and at least one transition point C.

The radius of curvature of the meniscus can be used to determine whether a fluid will flow in the forward direction, or if the fluid will stop in the backward direction. Simple guidelines are that concave equals forward movement, and convex equals stop in backward direction.

The definition for concave means "curving in" or "hollowed inward" meaning that an object is bent to some extent towards its center point. In the present application, concave fluids are illustrated in FIGS. 4A and 4B. Concave-shaped liquid fronts, with the capillary force as the driving force behind them, will facilitate liquid movement in all directions indicated in FIGS. 4A and 4B. As illustrated in FIG. 4C, the liquid front has a concave shape with regard to the center point of the liquid, and the radius of curvature r is given by an (imaginary) circular fit through the droplet front. For the situation illustrated in FIG. 4A, the radius of curvature is illustrated in FIG. 4C. The radius of curvature r is the radius of an imaginary sphere that "dents" the droplet inwards on both sides.

Figure 5:
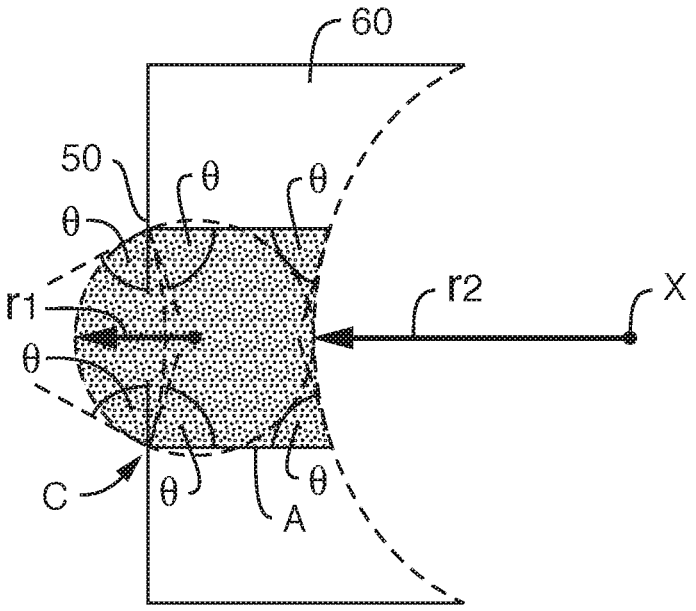
FIG. 5 is a schematic cutaway view of a junction between the conic capillary component of FIG. 4B and the connective capillary component of FIG. 4A with an abrupt narrowing forming a singular transition point resulting in directional flow, indicated at C in FIG. 3. The radii of curvature r1 and r2 in FIG. 5 are of different lengths.

In contrast, convex means "arched" or "arched outwards." In the present application, convex fluids are illustrated in FIG. 5. The convex radius on the left-hand side hinders the fluid from flowing in the backward direction. In this case, the imaginary sphere originates inside the liquid drop and the radius of curvature is given by r1. The concave-shaped liquid front on the right-hand side has a radius of curvature r2. Because of the asymmetry of the capillary walls, there are two different radii of curvature for one liquid droplet, resulting in an asymmetric capillary driving force for the droplet and facilitating directional flow.

The curvature for any above-described case is then determined by the Young-Laplace equation: If the dominant pressure component resides within the droplet it will form a concave curvature, if it is outside, it will form a convex curvature.

EXAMPLES

Example

A connective section is indicated at A in FIG. 3 and is shown schematically in FIG. 4A. The design of the connective section A allows for bi-directional flow. To illustrate an example geometry of the connective section A the following derivation is employed for the capillary driving pressure difference Δp, which is described by the Young-Laplace equation:

$$\Delta p=\gamma/h(x)\cdot(-1+\cos\theta(x)+2a(x)\cos(\alpha(x)/2)\cos(\theta(x)-\alpha(x)/2)).$$

Here γ denotes the surface tension of the liquid to the ambient gas, h(x) the depth of the capillary, a(x) the aspect ratio of the capillary and α(x) the angle of slope of the connective capillary's wall. The aspect ratio is the depth of the capillary h(x) divided by its width. Here θ represents the contact angle of the liquid to the solid.

Example straight, connective section of type A with alpha α=0

$$\Delta p=\gamma/h\cdot(-1+\cos\theta+2a(x)\cos(0)\cos(\theta))$$

$$\Delta p=\gamma/h\cdot(-1+\cos\theta+2a(x)\cos(\theta))$$

$$\Delta p=\gamma/h\cdot(-1+\cos\theta(1+2a(x))$$

The following equation has to be fulfilled for bi-directional liquid transport in the example connective capillary with a constant aspect ratio of $a_{connective}$.

$$\Delta p=\gamma/h\cdot(-1+\cos\theta(1+2a(x))>0$$

$$-1+\cos\theta(1+2a_{connective})>0$$

$$\cos\theta(1+2a_{connective})>1$$

$$1+2a_{connective}>1/\cos\theta$$

$$2a_{connective}>(1/\cos\theta)-1$$

$$a_{connective}>\tfrac{1}{2}((1/\cos\theta)-1)$$

As a result, the condition $a_{connective}>\frac{1}{2}((1/\cos\theta)-1)$ must be satisfied, and the connective section A needs to be hydrophilic.

A diverging section is indicated at B in FIG. 3 and is shown schematically in FIG. 4B. The generally conic design of the diverging section B with small angles of slope α also allows for bi-directional flow. It should be noted that α does not need to be constant along the diverging section. To illustrate an example geometry of the diverging section B the following derivation is employed for the capillary driving pressure difference $\Delta p_{conic}$ that is described by the Young-Laplace equation:

$$\Delta p_{conic,\pm}=\gamma/h_{conic}(x)(-1+\cos\theta(x)+2a_{conic}(x)\cos(\alpha(x)/2)\cos(\theta(x)\pm\alpha(x)/2)).$$

Here $\Delta p_{conic,+}$ and $\Delta p_{conic,-}$ are the capillary driving pressure differences in the forward direction and the backward direction, respectively. Here γ denotes the surface tension of the liquid to the ambient gas, $h_{conic}(x)$ the depth of the capillary, $a_{conic}(x)$ the aspect ratio of the conic capillary and α(x) the angle of slope of the conic capillary's wall. The aspect ratio is the depth of the capillary $h_{conic}(x)$ divided by its width. Here θ represents the contact angle of the liquid to the solid.

The following equation has to be fulfilled for bi-directional liquid transport in the example conic capillary with an aspect ratio of $a_{conic}(x)$.

$$-1+\cos\theta+2a_{conic}(x)\cos(\alpha/2)\cos(\theta\pm\alpha/2)>0$$

$-1+\cos\theta$ is always negative (unless θ=0 in which case the expression is 0).

Therefore, $2a_{conic}(x)\cos(\alpha/2)\cos(\theta\pm\alpha/2)>+1-\cos\theta$ in order for the expression to be >0

Additionally, cos(θ+α/2) requires that 0 degrees<θ+α/2<90 degrees in order to be positive; cos(θ−α/2) requires 0 degrees <θ−α/2<90 degrees in order to be positive.

Converting to radians, α/2<π/2−θ and α/2<θ must be true for the expressions to be >0, if the before assumptions of a contact angle of 0 degrees<θ<90 degrees and an angle of slope of 0 degrees<α<90 degrees hold.

A transition section is indicated at C in FIG. 3 and is shown in more detail in FIG. 5. The junction between the generally conic diverging section B and the transition section C results in an abrupt narrowing in the forward direction 40 forming a singular transition point 50 resulting in directional flow in the forward direction 40. The transition section C can be disposed along the length of the diverging section B in a position that is at 50 percent of the length, or in a position that is greater than 50 percent of the length, with the length being measured from the junction between the connective section A and the diverging section B. Such an arrangement prevents backflow in the backward direction 45. In other words, the transition of the fluid front from concave to convex at the transition point 50 in the transition section C halts the transport of fluid in the backward direction 45.

Figure 2B:
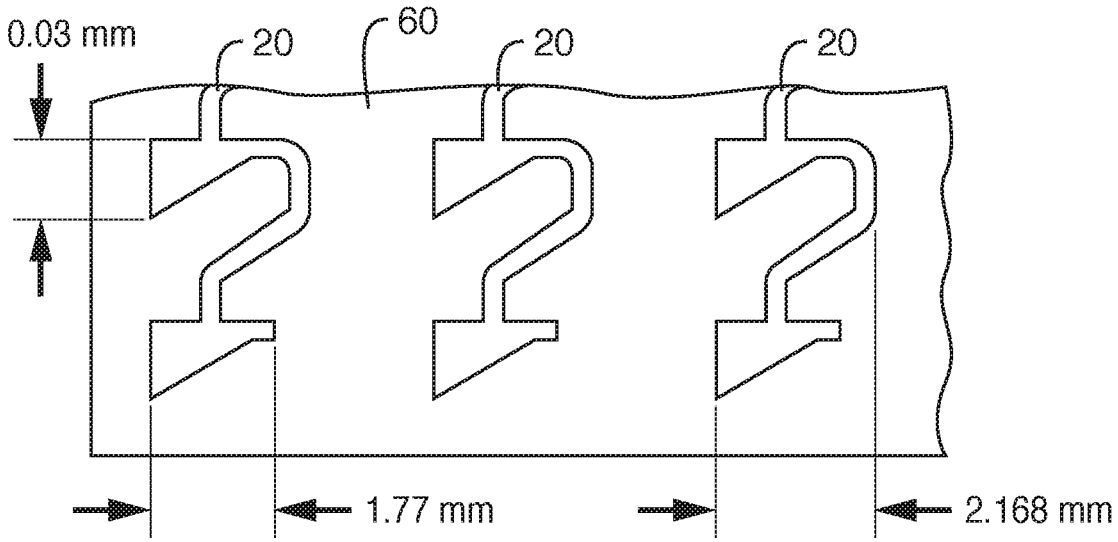
FIG. 2B is a schematic close-up plan view of the parallel arrangement of multiple capillaries of FIG. 2A, with exemplary dimensions.

This was prototyped in PMMA and shown to work with soapy water. Samples were fabricated from poly(methyl methacrylate) (PMMA) plates by laser ablation using a carbon dioxide laser with a main wavelength in the infrared range of light. The structure was fabricated with eight capillaries and with capillary dimensions and arrangements as shown in FIGS. 2A and 2B with a period length of 2.4 mm and an opening angle of 26.6°. The width of the straight capillary sections was 0.3 mm. An aqueous solution of 0.72 v % soap concentrate (DAWN® brand liquid soap) with an aqueous red dye from Ponceau S (3.85 v %) was used. This test liquid was measured to have a static contact angle of 56°±2° (n=6) on PMMA and a surface tension in the range of 24 mN/m to 30 mN/m at standard laboratory conditions. A droplet of approximately 200 microliters of test liquid was placed onto the sample. Video analysis revealed that all eight capillaries on the sample transported the fluid in the forward direction with a velocity in the range of mm/s, while stopping the liquid fronts in the opposite direction for test distances of about 26 mm in both directions. In another test, a droplet of 50 microliters of the test liquid was placed onto a single capillary and five consecutive transport cycles were recorded by a video camera. The sample transported the test fluid in the forward direction, while halting the liquid front in backward direction. The data indicated a linear relationship between the distance traveled by the fluid fronts in the forward direction and the traveling time. The transport velocity was in the range of 1 mm/s. By linear regression, the corresponding fit curves and velocity values for each measurement cycle were found. From all linear fits a mean fit curve and a mean velocity value of 1.04 mm/s±0.02 mm/s (±2%) in the forward direction were calculated. Applying a droplet of 90 microliters to the sample surface, it was found that directional flow can withstand an angle of inclination of 25° for the test distance of 28 mm.

In a first particular aspect, a capillary structure for passive, directional fluid transport includes a capillary having a forward direction and a backward direction, the capillary including first and second capillary units each having a sequence of capillary components including a connective section in fluid communication with a diverging section, the diverging section having a forward side and dimensions inducing a concave meniscus in the forward direction, wherein the connective section of the second capillary unit is connected to the forward side of the diverging section of the first capillary unit to form at least one transition section, and wherein a change in the dimensions in the transition section induces in the backward direction a convex liquid meniscus or a straight liquid meniscus with an infinite radius of curvature.

A second particular aspect includes the first particular aspect, wherein each capillary unit is at least partially open in a z-direction.

A third particular aspect includes the first and/or second aspect, wherein each capillary unit is closed in a z-direction.

A fourth particular aspect includes one or more of aspects 1-3, further comprising a plurality of capillaries disposed in parallel to each other.

A fifth particular aspect includes one or more of aspects 1-4, wherein each capillary is without an interconnection to another capillary.

A sixth particular aspect includes one or more of aspects 1-5, wherein a contact angle of a given liquid with regard to the capillary is less than 90°.

A seventh particular aspect includes one or more of aspects 1-6, wherein the capillary is hydrophilic.

An eighth particular aspect includes one or more of aspects 1-7, wherein the capillary is lipophilic.

A ninth particular aspect includes one or more of aspects 1-8, wherein the transition section halts fluid transport in the backward direction.

A tenth particular aspect includes one or more of aspects 1-9, wherein the diverging section has a length measured from an intersection of the connective section with the diverging section, and wherein the transition section is disposed at greater than 50 percent of the length.

An eleventh particular aspect includes one or more of aspects 1-10, wherein the diverging section has a length measured from an intersection of the connective section with the diverging section, and wherein the transition section is disposed at 50 percent of the length.

A twelfth particular aspect, a substrate for directional transport of a fluid having a contact angle θ, the substrate including a capillary structure for passive, directional fluid transport, the capillary structure including a capillary having a forward direction and a backward direction, the capillary including first and second capillary units each having a sequence of capillary components including a connective section in fluid communication with a diverging section, the diverging section having a forward side and dimensions inducing a concave meniscus in the forward direction, wherein the connective section of the second capillary unit is connected to the forward side of the diverging section of the first capillary unit to form at least one transition section, and wherein a change in the dimensions in the transition section induces in the backward direction a convex liquid meniscus or a straight liquid meniscus with an infinite radius of curvature.

A thirteenth particular aspect includes the twelfth particular aspect, wherein the capillaries are disposed in a parallel arrangement.

A fourteenth particular aspect includes the twelfth and/or thirteenth aspect, wherein a contact angle of a given liquid with regard to the substrate is less than 90°.

A fifteenth particular aspect includes one or more of aspects 12-14, wherein each capillary unit is open in a z-direction.

A sixteenth particular aspect includes one or more of aspects 12-15, wherein each capillary has forward and backward directions, and wherein each transition section halts fluid transport in the backward direction.

In a seventeenth particular aspect, a capillary structure for passive directional transport of a fluid having a contact angle θ with regard to the capillary structure includes a capillary including a plurality of capillary units each having a sequence of capillary components including a connective section in fluid communication with a diverging section, the diverging section followed by a transition section, wherein the connective section has an aspect ratio $a_{connective} > \frac{1}{2}(1/\cos\theta)-1)$, wherein the diverging section diverges from the connective section at an angle α such that $\alpha/2 < \pi/2-\theta$, and wherein the transition section incorporates an abrupt change in width from the diverging section of one capillary unit to the connective section of the next capillary unit.

An eighteenth particular aspect includes the seventeenth particular aspect, further comprising a plurality of capillaries disposed in parallel to each other.

A nineteenth particular aspect includes the seventeenth and/or eighteenth particular aspects, wherein each capillary is without an interconnection to another capillary.

A twentieth particular aspect includes one or more of aspects 17-19, wherein the transition section halts fluid transport in the backward direction, These and other modifications and variations to the present disclosure can be practiced by those of ordinary skill in the art, without departing from the spirit and scope of the present disclosure, which is more particularly set forth in the appended claims. In addition, it should be understood that aspects of the various aspects of the present disclosure may be interchanged either in whole or in part. Furthermore, those of ordinary skill in the art will appreciate that the foregoing description is by way of example only, and is not intended to limit the disclosure so further described in such appended claims.

What is claimed:

1. A capillary structure for passive, directional fluid transport, the structure comprising:

a capillary having a forward direction and a backward direction, the capillary comprising first and second capillary units each having a sequence of capillary components including a connective section in fluid communication with a diverging section, the second capillary unit being downstream of the first capillary unit in the forward direction, the diverging section having a forward side and dimensions including a section of increasing width in the forward direction inducing a concave meniscus in the forward direction, wherein the connective section of the second capillary unit is connected to the forward side of the diverging section in the section of increasing width of the first capillary unit to form at least one transition section, and wherein a change in the dimensions in the at least one transition section induces in the backward direction a convex liquid meniscus or a straight liquid meniscus with an infinite radius of curvature.

2. The capillary structure of claim 1, wherein each capillary unit is at least partially open in a z-direction.

3. The capillary structure of claim 1, wherein each capillary unit is closed in a z-direction.

4. The capillary structure of claim 1, further comprising a plurality of capillaries disposed in parallel to each other.

5. The capillary structure of claim 4, wherein each capillary is without an interconnection to another capillary.

6. The capillary structure of claim 1, wherein the capillary is hydrophilic.

7. The capillary structure of claim 1, wherein the capillary is lipophilic.

8. The capillary structure of claim 1, wherein the at least one transition section halts fluid transport in the backward direction.

9. A substrate for directional transport of a fluid having a contact angle θ, the substrate comprising a capillary structure for passive, directional fluid transport, the capillary structure comprising a capillary having a forward direction and a backward direction, the capillary comprising first and second capillary units each having a sequence of capillary components including a connective section in fluid communication with a diverging section, the second capillary unit being downstream of the first capillary unit in the forward direction, the diverging section having a forward side and dimensions including a section of increasing width in the forward direction inducing a concave meniscus in the forward direction, wherein the connective section of the second capillary unit is connected to the forward side of the diverging section in the section of increasing width of the first capillary unit to form at least one transition section, and wherein a change in the dimensions in the at least one transition section induces in the backward direction a convex liquid meniscus or a straight liquid meniscus with an infinite radius of curvature.

10. The substrate of claim 9, wherein the capillary structure comprises a plurality of capillaries disposed in a parallel arrangement.

11. The substrate of claim 9, wherein each capillary unit is open in a z-direction.

12. The substrate of claim 10, wherein each capillary of the plurality of capillaries has forward and backward directions, and wherein each transition section of each of the plurality of capillaries halts fluid transport in the backward direction.

* * * * *